United States Patent [19]

Rilett

[11] 4,092,830

[45] June 6, 1978

[54] GAS DRIVEN MOTOR WITH BUFFER SPACE

[76] Inventor: John Walter Rilett, 18 Links View, Stratton, Cirencester, England

[21] Appl. No.: 759,133

[22] Filed: Jan. 13, 1977

[30] Foreign Application Priority Data

Jan. 16, 1976 United Kingdom ..... 1689/76
Jun. 21, 1976 United Kingdom ..... 25600/76

[51] Int. Cl.[2] ..... F01K 25/10
[52] U.S. Cl. ..... 60/671; 62/50
[58] Field of Search ..... 60/651, 671; 62/50

[56] References Cited

U.S. PATENT DOCUMENTS

| | | | |
|---|---|---|---|
| 3,062,017 | 11/1962 | Balcar | 62/50 |
| 3,941,124 | 3/1976 | Rodewald | 62/50 X |
| 3,987,632 | 10/1976 | Pereda | 60/671 |

*Primary Examiner*—Allen M. Ostrager
*Attorney, Agent, or Firm*—Dennison, Dennison, Meserole & Pollack

[57] ABSTRACT

A motor of the kind which is driven by gas evaporated from a liquefied gas has in combination therewith gas supply apparatus comprising a vessel containing the liquefied gas, a passage in communication with the motor for the flow of gas evaporating from the liquefied gas in the vessel, valve or other means operable to permit gas evaporating from the liquefied gas to flow into the motor, and, in thermal communication with the vessel or the passage (or both), a container charged with a buffer substance (which is normally a liquid which has a freezing point at normal pressure above the boiling point of the liquefied gas) which acts as a source of heat.

10 Claims, 7 Drawing Figures

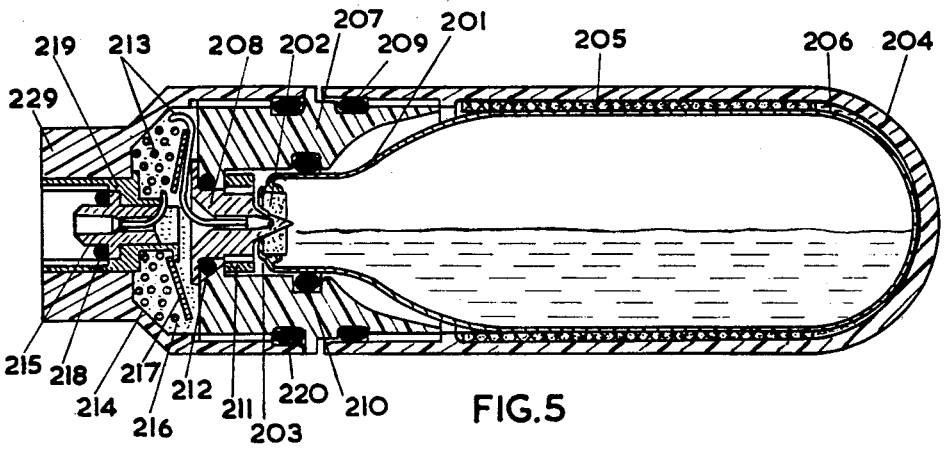
FIG.5
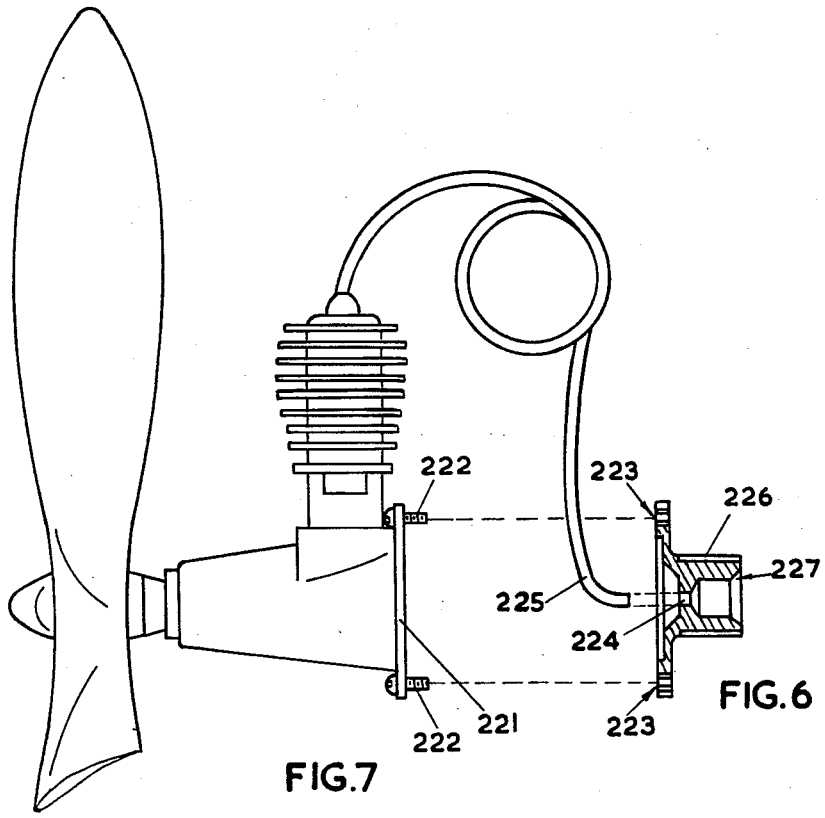
FIG.6
FIG.7

GAS DRIVEN MOTOR WITH BUFFER SPACE

BACKGROUND OF THE INVENTION (a) Field of the Disclosure

This invention relates to motors of the kind that are driven by gas evaporated from a liquefied gas such as liquid carbon dioxide or liquid nitrogen.

(b) Description of the Prior Art

Motors which run on liquefied gases are known and have for instance been used to drive model aircraft (using sometimes a bottle of pressure-liquefied carbon dioxide).

A major difficulty which arises with such motors is the progressive fall in gas pressure which occurs as gas flows from the bottle or tank in order to drive the motor, and which limits the power of the motor to a rather low level. This fall in pressure is a consequence of the cooling of the gas as it attempts to evaporate from the liquid state in the supply bottle and to expand against ambient pressure during consumption by the motor. This cooling effect becomes worse as one attempts to increase the speed and power of the motor and can even cause formation of ice on the outside of the bottle. Furthermore the cooling of the gas causes its density to increase with the result that gas consumption is increased undesirably. A further disadvantage of existing motors powered by vaporised gas arises because the gas taken from the bottle for such existing motors is at or near the condition known as "saturation" with the consequence that, as soon as it is expanded in the motor, it inevitably condenses partly back into its liquid or even its solid state.

Apart from the possibility of damage to the motor such condensation also causes a large increase in the specific volume of the working fluid and this requires that the motor should have a high expansion ratio in order adequately to expand the working fluid and so extract its available energy, and this in turn leads to the need for an undesirably large motor, or to an undesirably low charge volume (which reduces motor power), or to the need for excessively high rpm in order to secure sufficient power from the motor. Our proposal for overcoming the problem of condensation of the gas in the motor is to superheat the gas before use in the motor, that is, to increase its temperature at sensibly constant pressure, or to reduce its pressure at sensibly constant temperature (or any combination of these two processes).

Although the value of superheating has sometimes been recognised in existing motors, the usual technique of achieving it has been by leading the gas from the supply bottle through fine-bore metal tubing before admission to the motor, this metal tubing usually being coiled and positioned so that ambient air flows over the tubing during operation. Existing motors are usually adapted to fly model planes and so have a propellor which blows air over the metal tubing. This technique gives a small but significant improvement in performance, though not overcoming the problem of condensation, diseconomy, power loss and possible motor damage at high power settings and, being reliant on the temperature of the ambient air to provide the superheating, is not very effective in cold weather when the extent of power loss can be severe. Moreover it does not give a significant expansion of the gas as it passes to the motor.

It is well known to heat by means of circulating warm fluids, parts of liquefied gas storage apparatus so as to prevent excessive frost from being deposited on such as apparatus during storage of the liquefied gas. Such heating systems are, for example, disclosed in U.S. Pat. Nos. 3,122,891 and 3,850,001.

It has been proposed in U.S. Pat. No. 3,466,196 to surround with a water jacket electronic equipment sealed in a shell before the shell is launched from the earth as part of an orbiting satellite or weather balloon. If the satellite or weather balloon reaches an altitude in the order of 30,000 meters it will be subjected to a temperature of −50° to 60° C. At such temperatures the water freezes thereby providing longterm protection of the equipment against extreme cold.

OBJECTS OF THE INVENTION

It is an object of the invention to provide improved means for superheating the gas evaporated from the liquefied gas.

It is a further object of the invention to provide gas supply apparatus for driving a small motor suitable for powering a model or toy aircraft.

GENERAL DESCRIPTION OF INVENTION

According to the invention there is provided a motor having in combination therewith apparatus for supplying to the motor gas evaporated from liquefied gas, said apparatus comprising a vessel containing liquefied gas, a passage which affords communication between the vessel and the motor whereby gas evaporating from the liquefied gas is conducted into the motor, and, in heat conductive relationship with the vessel, at least one container holding a buffer substance which during operation of the motor releases heat to the vessel and the liquefied gas therein whereby the tendency of the evaporation of the liquefied gas to cool the remaining liquefied gas in the vessel is at least partly counteracted.

The invention also provides a motor having in combination therewith apparatus for supplying to the motor gas evaporated from liquefied gas, said apparatus comprising a vessel containing liquefied gas, a passage which affords communication between the vessel and the motor whereby gas evaporating from the liquefied gas is conducted into the motor, and, in heat conductive relationship with at least one container holding a buffer substance which during operation of the motor releases heat to evaporated gas as it passes through the passage thereby raising the temperature of said evaporated gas.

By the term "buffer substance" is meant a substance which undergoes a change in its physical, chemical, crystallographic or other state at a temperature between ambient temperature and the final operating temperature of the liquefied gas, the change of state then causing a release of heat, or which by other means releases heat (eg sensible heat) to the liquid or evaporated gas.

This heat may be derived from its latent heat of fusion, or from its latent heat of vapourisation, or from its heat of hydration, or from any other effect which causes a significant release of heat at a certain falling temperature and which, advantageously, re-absorbs that heat reversibly as the temperature rises again. Substances from which the buffer substance may be selected include a very large number of alternatives (as listed for instance in the CRC "Handbook of Chemistry and Physics", 55th Edition, Pages, B63 to B156, B-243 to B-247, C-639 to C-658, and C-680 to C-179).

Motors making use of this buffering technique are referred to herein as "stored energy motors" because their buffer substances effectively store heat energy which is released. to the working fluid for conversion into power as the motor runs. In the case of stored energy motors running on $CO_2$ at normal ambient temperatures, suitable buffers include acetic acid (MP circa 16° C), formic acid (MP circa 8° C), and water (MP 0° C), and mixtures of these materials which allow other melting points to be achieved: for instance a mixture of 99% acetic acid and 1% water by volume has a melting point near 10° C which is useful for stored energy motors running in temperate climates. The above buffers are attractive by virtue of their high latent heats of fusion, whereby a relatively small amount of buffer substance suffices (eg one gram of buffer per three or four grams of $CO_2$ in the case of a water buffer). The above buffers are also very inexpensive and so may be used, for example, in disposable $CO_2$ bulbs. Another desirable quality of the buffer substance is a high thermal conductivity, to facilitate heat flow from the buffer into the $CO_2$ (or other gas being used), and into the buffer from the surrounding environment. Water is particularly good in this respect. The function of the buffer substance in thermal contact with the vessel is to prevent the liquefied gas from sustaining a serious fall in temperature and pressure as it evaporates. The buffer achieves this function by releasing heat to the liquefied gas as its temperature attempts to fall. For example the buffer may be a substance which has a melting point of 0° to 10° C and which is therefore in its liquid state at normal ambient temperatures. Then, in the case of a $CO_2$ motor for example (though the invention is equally applicable to other gases), as the $CO_2$ gas is drawn off to drive the motor the remaining $CO_2$ in the bottle will become colder but, being in good thermal communication with the buffer, the buffer will also become colder. However the buffer will resist this fall in temperature in two ways: firstly by releasing its own sensible heat as its temperature falls towards the freezing temperature of the buffer and below; and secondly when its temperature falls slightly below the freezing point it will begin to freeze and, in doing so, it will release its latent heat of fusion to the $CO_2$ in the supply bottle and so arrest the fall in temperature of the $CO_2$ at a level not far below the freezing point of the buffer thus maintaining the pressure of the $CO_2$ and the power of the motor at a sensibly constant level.

At the end of the power run the buffer will furthermore melt again as heat from the surrounding environment flows naturally into it. This provides a further store of heat energy for the next run of the motor and this process may of course be repeated indefinitely.

The vessel may if desired be detachable from the rest of the motor. It may be disposable or refillable. If desired, gas supply apparatus may be provided to convert an existing motor into one according to the present invention. Another possibility is to provide gas supply apparatus which may be used interchangeably with more than one motor. Such gas supply apparatus may have a passage in thermal communication with a container for buffer substance. By appropriately selecting the buffer substance a suitable degree of superheating may thereby be achieved.

According to another aspect of the present invention there is provided gas supply apparatus for use in association with a motor to constitute the motor according to the first aspect of the invention, the gas supply apparatus comprising a vessel containing liquefied gas under pressure or capable of being charged with liquefied gas, a passage in communication at one of its ends with the vessel or being capable of being placed in communication with the vessel by operation of valve or other means, which apparatus has in heat conductive relationship with the vessel or the passage or both at least one container holding or capable of being charged with buffer substance (as hereinbefore defined), and adaptor means capable of connecting the gas supply apparatus to the motor such that the outlet of the passage communicates with the chamber(s) which house(s) the rotary or reciprocable element(s) of the motor.

If desired, the passage may form part of a superheater. Alternatively, the superheater may be provided in the body of the motor itself.

Advantageously the adaptor is shaped to match the mounting flange of the motor so that the motor may be fixed to the adaptor. The adaptor is next provided with one socket (or a plurality of sockets, in the case of existing motors with more than one cylinder) so that the inlet feed tubing of the existing motor may be easily soldered into this socket. Alternatively one may provide an 'O' ring or olive connection between the inlet feed pipe and the adaptor, in the known manner of pipe couplings. The adaptor is also advantageously provided with means (preferably sealed by an 'O' ring) to provide a gas-tight connection with the gas supply apparatus, preferably in the form of a screw coupling or snap coupling. By this means, once the adaptor has been connected and fixed to the motor, the motor may be quickly fitted to the gas supply apparatus, and repeatedly removed and recoupled if so desired. This facility is particularly desirable in its application to model aircraft and toys, since it allows one motor to be quickly moved from one model or toy to another as desired, each model or toy having its own individual gas supply apparatus permanently fitted. The adaptor may be a male or female member on the gas supply apparatus adapted to mate with a complimentary female or male member on the motor.

If desired the vessel may be a sealed bulb containing liquefied gas. The motor or gas supply apparatus may have piercing means capable of breaking the seal and thereby placing the vessel in communication with the passage. Accordingly, a yet further aspect of the present invention provides gas supply apparatus for association with a positive-displacement or turbine motor to constitute a motor according to the first aspect of the invention, the gas supply apparatus including a holder adapted to receive a vessel containing liquefied gas, the holder having on its inner surface:

(a) a closed or refillable jacket containing or adapted to be charged with buffer substance (as hereinbefore defined) such that on insertion of the vessel into the holder, the jacket comes into heat-conducting relationship with the vessel; or (b) sealing means adapted to make a liquid-tight seal with the vessel, the holder being shaped and constructed such that it is capable of defining with the vessel a jacket for buffer substance (as hereinbefore defined) around the vessel, and a body member or body assembly engageable with the holder and the motor or an adaptor connected to the motor, the body member or body assembly having a passage able to be placed in communication at one of its ends with the ullage space of the vessel and at its other end with a chamber (or chambers) housing the rotary or reciprocable element(s) of the motor.

The motor or gas supply apparatus according to the invention may be sold with the or each container charged with buffer substance. Alternatively, the or each container may be adapted to be charged with buffer substance by the user of the motor.

The container may conveniently comprise a jacket surrounding the vessel. It is advantageous to encourage the flow of heat by the use of metal foam to carry the buffer (especially when the buffer is in a cavity or jacket surrounding the vessel), or partly to fill the container or jacket holding the buffer with fine metal mesh, gauze, filings, swarf, powder or woven or knitted metal wire so as to form a latticework of heat flow paths throughout the buffer. It is advantageous to arrange for the length of these heat flow paths within the latticework to be as small as possible as a means of increasing the rate of heat transfer, together with the use of the smallest convenient size of pocket or voids containing the buffer. The or each container may alternatively be situated in the vessel itself. A closed tube or small capsules may for example be used. The size of such capsules should preferably be below 1 mm diameter and preferably as small as 0.2 mm diameter.

In the case of disposable or other supply bulbs (for example "Sparklets" (RTM) bulbs of $CO_2$) which are to be enclosed within a jacket containing the buffer, it is desirable either to make such bulbs from a high thermal conductivity material which is also corrosion resistant (such as aluminium or one of its alloys) or, if it is made of an inexpensive but corrodible material such as steel (as in the case of standard "Sparklets" bulbs), to plate or paint or coat the surface of the supply bottle with a corrosion-resisting material which is also a good conductor of heat. Conventional paints are not satisfactory in this respect being poor conductors of heat and it is advantageous to use a paint which is, firstly, applied as a coating of less than 0.1 mm (and preferably less than 0.05 mm) in thickness and, secondly, which has a thermal conductivity of at least 0.002 cal/sec.cm.° C and preferably nearer to 0.005 cal/sec.cm.° C, after application and subsequent drying or curing. This may be achieved with paints containing finely divided metals such as aluminium powder, or finely divided metal oxides such as zinc oxide or benyllium oxide or finely divided graphite such as "Shawinigan" Black in which the graphite is in the form of tiny needless which tend to link up to form heat flow paths, or other fillers which allow the thermal conductivity to reach the figures specified above.

Alternatively the tank may be made of inexpensive material such as plastics, and, because such material may not conduct heat very effectively, the buffer may be held within the vessel in a closed tube or in small capsules.

A preferred way of achieving an effective degree of superheating in accordance with the invention is to arrange for the passage to be so adapted that it causes, in operation of the motor, a pressure drop of more than 10% of the saturation pressure of the liquid gas at the prevailing temperature, whereby the speed of the motor is able to be stabilised. Thus, the passage may for at least part of it's length define a tortuous or winding path for the flow of evaporated gas from the vessel to the motor. At least part of the tortuous or winding path is preferably in heat-conductive relationship with a container holding or capable of being charged with buffer substance. Preferably, the buffer substance in thermal contact with the superheater has a freezing point greater than that of the buffer substance in thermal contact with the vessel. The passage may at least in part be defined by coiling tubing. The tubing may have a length of from ½ to 1 meter and a bore of up to, say, 0.25 mm. By way of example, gas boiled off at a little below 0° C from a vessel buffered with water may then be superheated to approximately 10° C by means of an acetic acid buffer (MP about 12° C by means of water addition). In addition the long fine-bore superheater coil causes a pressure reduction of typically 150 psi (compared with typically 0.2 p.s.i. in previously known designs), which helps to bring about the required degree of superheating heat transfer and which, furthermore, causes any incipient slowing down of the motor to be compensated for by a lessening of such pressure reduction (i.e. it causes an increase in gas supply pressure to the motor) which tends to stabilise the motor speed and power. Alternatively the pressure drop may be effected by providing a porous plate or plug in the passsage.

Existing $CO_2$ motors, when linked with gas supply apparatus employing buffering of the vessel and superheater can develop three to five times as much power, higher and more constant r.p.m., freedom from icing, condensation and risk of motor damage, and adequate performance in cold weather.

The motors according to the invention may be employed in such things as power tools (domestic and industrial), hedge-trimmers, portable chain saws, toys, models, dentists' drills, lawn mowers and light automotive vehicles. They are particularly suitable for use in toy or model aeroplanes. Particular advantages of the motor according to the invention include its avoidance of the need for a trailing electrical power lead (as in domestic power tools etc) or compressed-air hose (as in industrial power drills and garage equipments); the rapidity with which it may be recharged (a few seconds to refill with gas versus several hours to recharge batteries); its smaller size and weight; its lack of any fire risk, electrical danger or radio interference; its avoidance of the use of toxic or dangerous chemicals as in lead-acid and other batteries; its low cost of manufacture and of operation; its controllability of speed and power; and its ability to use safe natural gases (i.e. as found in the clean atmosphere) which, after use, are returned back to the atmosphere without pollution.

Suitable liquefied gases for use with the motor may be classified into two distinct categories; those which at normal temperatures may be liquefied by pressure alone (for example carbon dioxide); and those such as nitrogen which must be cooled below normal atmospheric temperatures before liquefaction is possible even under pressure. Gases of the latter category must be stored in well-insulated tanks if they are to remain in the liquid state. Gases of the former category do not require to be kept cold in order to remain liquid and are therefore more easily handled and stored in the liquid state, which confers advantages of compactness, design simplicity and convenience.

BRIEF DESCRIPTION OF DRAWINGS

The invention will now be described by way of example with reference to the accompanying drawings of which:

FIG. 5 is a longitudinal cross-section of gas supply apparatus according to the invention containing a disposable supply bulb such as a "Sparklets" bulb.

FIG. 6 is a longitudinal cross-section of an adaptor suitable to adapt known types of existing model $CO_2$ motors to fit the gas supply apparatus shown in FIG. 5.

FIG. 7 is a view in elevation of a typical existing model $CO_2$ motor.

DESCRIPTION OF PREFERRED EMBODIMENTS

Figure 1:
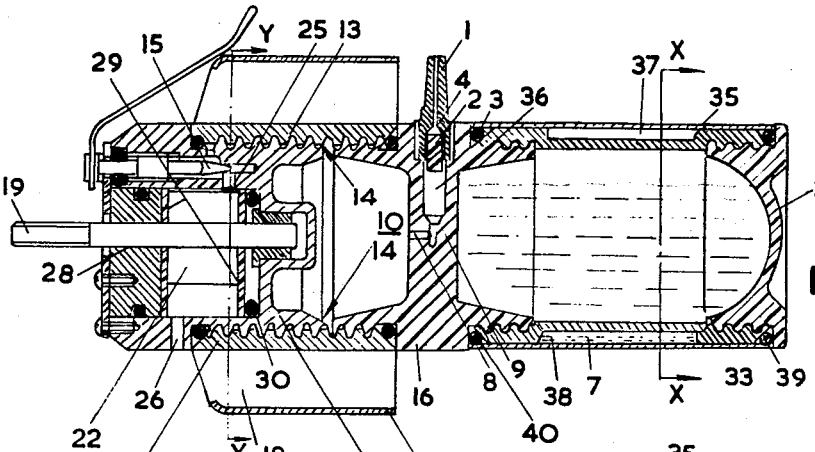
FIG. 1 is a longitudinal cross-section of a stored energy motor according to the invention, which motor has an integral liquefied gas tank.

With reference to FIG. 1, the motor has a tank (or vessel) 33 which is defined by shaped coupling members 16 and 34 in screw threaded engagement with a sleeve 35 of good heat-conductive metal. To enable it to be charged with liquefied gas the motor has a fill nozzle 1 whose lower end (as shown) is mounted in the coupling member 16 in a passage (or opening) 36 which communicates with the interior of the tank 33 by way of an orifice 3. The internal surface of the nozzle 1 has a frustoconical surface 4 which acts as an upper valve seat engaging elastomeric plug 2.

At the lower end (as shown) of the passage 36 is a lower frusto-conical valve seat 9 engageable with the plug 2 to seal from the tank a gas space 10 of chosen volume relative to that of the tank in communication with the passage 36 by way of a second orifice 8. The gas space is defined between one end of the coupling member 16 and one end of the cylindrical body of the motor, the coupling member 16 and body 11 being held in engagement by a sleeve 12 of heat conductive metal.

To charge the tank 33 with, say, liquid carbon dioxide, a refill cylinder (not shown) containing liquid $CO_2$ is applied to the nozzle 1 whereupon the plug is forced downwards into engagement with the lower valve seat 9 to place the tank 33 in communication with the nozzle 1. Liquid $CO_2$ thus flows into the tank 33 but not the gas space 10. The refill cylinder may be of conventional design. For example, it may operate in precisely the same manner as a butane cylinder for refilling cigarette lighters.

On withdrawing the refill cylinder, the plug 2 is returned by differential gas pressure to engage the upper valve seat 4. Because of the provision of the gas space 10 the motor is able to be constructed such that it complies with international legislation governing containers of compressed or liquefied gas. This legislation requires that not more than approximately 75% of the internal volume of the tank and motor assembly should be taken up by liquid $CO_2$, at 60° F. The remaining 25% is to be reserved for free gas space in order to accommodate expansion effects in hot climates. Thus, the ratio of volume of the gas space to that of the tank may be, for example, 25:75. When the charging is complete the required maximum permissible ratio of 75% liquid to 25% gas will thus not be exceeded.

As shown in FIG. 1, the sleeve 35 has a circumferential recess 37 in its outer surface. An outer sleeve of good heat conductive metal engages the outer surface of the (inner) sleeve 35 to define a closed cavity or (jacket) 38 for buffer substance 7.

When the jacket 38 is charged with the buffer substance (usually water) a small air space is left (see FIG. 2) to accommodate temperature-expansion effects. Elastomeric sealing rings 39 and 40 are engaged between the sleeves to prevent leakage of the buffer substance.

Saturated vapour evaporating from the tank 33 passes into the passage 36, through the orifice 8 and into the gas space 10. It then enters a passageway 13 which is defined between the body 11 of the motor and the sleeve 12. The sleeve 12 is in screw-threaded engagement with one end of the coupling member 16 and with one end of the body 11. The passageway 13 is helical and relatively long and narrow being defined between the screw threads on the sleeve 12 and those on the body 11, these screw-threads being suitably truncated. The adjacent ends of the body 11 and the coupling member 16 are spaced longitudinally apart from one another by a small distance to provide an entry for the vapour into the helical passageway 13.

The vapour enters the passageway 13 as shown by arrows 14 and makes its way to the motor via a needle control valve 15 and in doing so is heated to a temperature close to that of the sleeve 12 and the body 11 which, in the region of the engaging threads, are the warmest parts of the motor. The gas also experiences a loss in pressure due to frictional pressure drop in the helical passageway 13 and this, combined with the gas temperature rise, provides the gas with an adequate degree of superheating.

The coupling member 16 is preferably made of insulating material such as glass-reinforced nylon, so that the sleeve 12 and cylindrical body 11 are not cooled by thermal communication with the colder tank. In order to enhance further the degree of superheating, the sleeve 12 is provided with a plurality of fins 18 which link with a metallic shroud 17 which serves as a heat collector. The motor has a shaft 19. If the shaft is provided with a small fan or propellor in order to induce a flow of air over the motor shell with its fins and shroud, the temperature of the metal around the passageway 13 will closely approach that of the ambient air and thus impart to the $CO_2$ gas a temperature close to ambient.

Figure 2:
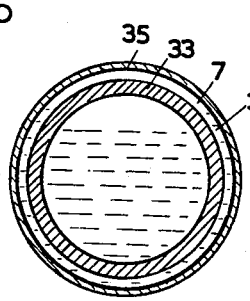
FIG. 2 is a transverse cross-section on line X—X of the gas tank.

An alternative method of enhancing the degree of superheating comprises the provision of a cavity or jacket around the shell in a way similar to that shown in FIGS. 1 and 2 for the tank. In this case a buffer substance is chosen for the cavity around the motor shell so that its buffering temperature is equal to or slightly above the superheat temperature desired. Thus, for instance, one could have a tank buffered at 0° C by means of a water jacket and the motor buffered at 16° C by means of an acetic acid jacket.

Figure 3:
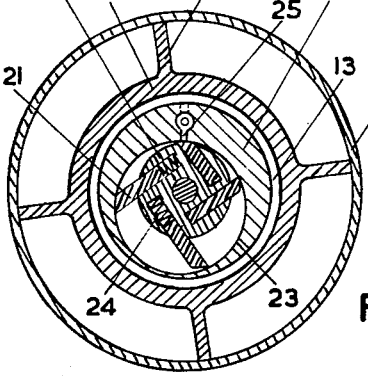
FIG. 3 is a transverse cross-section on line Y—Y showing the rotor and vanes used to expand and extract power from the gas.

The shaft carries a vaned rotor shown in FIG. 3. The rotor comprises a conventional design in which a plurality of vanes 21, advantageously made of oil-filled polyethylene plastic (injection moulded), slide in slots in the rotor 22 which may advantageously made by injection moulding of oil-filled acetal resin (or vice versa). The body 11 of the motor has an eccentric bore 23 defining a chamber for the rotor 22. The vanes 21 are spring-loaded outwards in the eccentric bore 23 of the body 11 either under the action of vane springs 24 or by gas pressure fed via suitable small bleed holes (not shown) to the inward edge of the vanes 21.

The superheated gas, having first been throttled to a greater or lesser degree by the adjustable needle control valve 15, enters the chamber 23 via an inlet port 25, drives the vaned rotor as it expands, and finally exhausts via port 26.

Prevention of escape of gas across the faces of the vaned rotor may be achieved by the provision of two-face sealing discs 29, of relatively soft and low frictional material such as PTFE or oil-filled polyethylene, which are pressed against the faces of the vaned rotor by means of an 'O' ring 30 or other compressible part such as a spring or spring-washer. The peripheries of the faces of the Rotor 22 preferably are provided with slightly raised rims (similar to the rims of coins) which wear into the face sealing discs and so inhibit the escape of gas across the faces of the vaned rotor. The 'O' ring 30 also prevents escape of gas sideways from the periphery of the vaned rotor assembly (where it meets the eccentric bore 23) and also being initially compressed, expands as wear occurs in the vaned rotor and face sealing discs so as to take up that wear and prevent gas leakage paths paths from developing.

Figure 4:
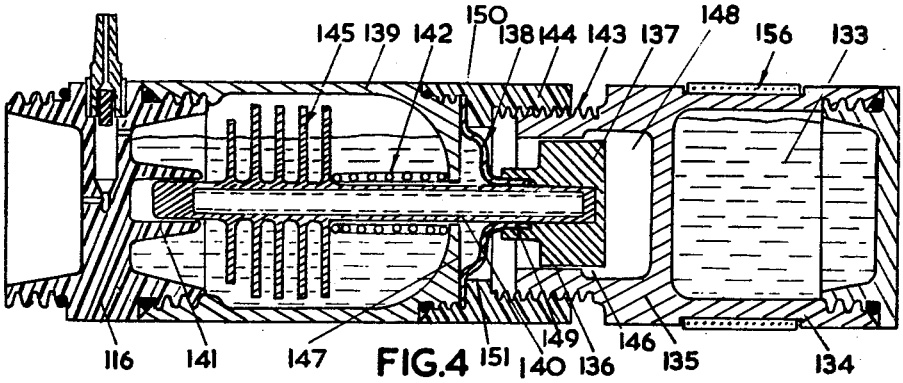
FIG. 4 is a longitudinal cross-section of a gas supply apparatus according to the invention incorporating means to increase motor power, reduce gas consumption and to stabilise and control gas pressure.

Higher motor powers and greater energy storage for a given amount of working fluid and buffer substance, and greater control and constancy of pressure and motor power as the tank is emptied, is achievable by the alternative tank assembly shown in FIG. 4. This design is of value in the larger-power and longer-duration-power applications such as lawn mowers, moped motors and light automotive motors, and in applications requiring higher power-to-weight ratios and lower gas consumption such as airborne power devices; it is described as follows:

A buffer substance 133 is held in a container 134 preferably of metal of high thermal conductivity and low weight such as aluminium alloy or magnesium alloy. The container, or a part thereof, has integral therewith an extension at one end which is in the form of a yoke 135. The yoke 135 has on its inner surface a step 146 and therefore has cylindrical portions 136 and 148 of narrower and wider bore respectively. Inside the yoke 135 and preferably closely-fitting with, and frictionally engaging, the portion 136 of narrower bore so as to provide good thermal communication with the yoke 135 is a metal block 137 (or other form of thermal pick-up) which can be translated along the axis of the yoke 135 in to positions in which its outer surface makes greater or less physical contact with the inner surface of the yoke 135. By this means the surface area of the boundary across which heat may flow from the yoke 135 to the metal block 137 (which is preferably also of metal of high thermal conductivity) can vary from zero up to a maximum as the metal block moves leftward in FIG. 4. Any radial clearance between the metal block 137 and the yoke 135 may advantageously be filled with a grease of high thermal conductivity, (for example silicone grease having zinc oxide dispersed therein) in order to improve heat flow.

The metal block acts as a bearing for one end of a rod of material of high thermal conductivity or a heat pipe 140 which extends leftward (as shown) through a flexible diaphragm 138 and a wall 147 integral with part of a tank 139, into the tank 139 itself. The diaphragm has an inner marginal portion 149 held in engagement between the heat pipe or rod 140 and the metal block 137 and an outer marginal portion 150 held in engagement between the wall 147 and the leftward (as shown) face of an inward projection 151 from a hollow generally cylindrical coupling member 144 in screw-threaded engagement with the tank 139. Liquefied gas is able to pass through an aperture in the wall 147 through which the heat pipe (or rod) 140 extends and thereby the diaphragm 138, in effect, acts as a closure or wall of the tank.

The leftward end (as shown) of the heat pipe (or rod) 140 is supported in a linear bearing 141 forming part of a coupling member 116, so that the heat pipe (or rod) may be translated leftward or rightward. A region of that part of the heat pipe (or rod) that is in the tank 139 has a plurality of fins 145 which may be axial or radial as shown in FIG. 4 and which extend into the liquefied gas in the tank 139. This arrangement facilitates flow of heat from the heat pipe (or rod) 140 into the tank 139.

Around the heat pipe 140 in the tank 139 is a compression spring 142 so arranged as to apply a leftward force on the heat pipe assembly, and scaled so that when gas pressure in the tank is at the desired level the metal block 137 is approximately in the position shown in FIG. 4.

The yoke 135 advantageously has an external thread 143 which engages a complementary internal thread of the coupling member 144. The coupling member 144 is preferably of thermally-insulating material such as glass-reinforced nylon so as to prevent undesirable flow of heat from the container 134 to the tank 139.

The engaging threads between the coupling member 144 and the yoke 135 allow the yoke 135 to be adjusted so as to provide greater or lesser thermal coupling between the inner surface of the yoke 135 and the metal block 137. This allows external adjustment of the controlled gas pressure in the tank 137 and thus of the power of a motor which can be connected to the left hand end (as shown) of the coupling member 116 in a manner similar to that shown in FIG. 1.

The function of the tank assembly shown in FIG. 4 in stabilising gas pressure will now be apparent as follows:

Any withdrawal of gas from the tank 139 will initially cause a slight fall in both the temperature and the pressure of the contained gas, and thus a fall in temperature of the left hand end of the heat pipe or metallic rod 140. The control spring 142, because of the said fall in tank pressure, will thus cause the heat pipe assembly to move leftward, increasing the thermal contact area between the metal block 137 and the yoke 135 which, being warmer than the now-cooling heat pipe assembly, will convey more heat into the heat pipe or metallic rod and thence via the fins 145 into the liquid gas, thus restoring and regulating its temperature and pressure and causing the diaphragm 138 to flex outwardly and return the heat pipe (or rod) rightwards (as shown).

An equal or greater advantage of this design of tank assembly is its ability to control the heat flow from a much larger store of heat. Thus, even if the buffer substance 133 is much hotter than the tank 139 and its contained liquid gas, heat flow into the liquefied gas will be regulated so as to maintain the desired gas pressure and not allow it to rise undesirably and cause a wasteful increase in gas consumption. The buffer substance may therefore be heated above ambient temperature before use, so as to store a greater amount of heat energy which, during later use, is tranferred to the working fluid and converted to useful energy in the motor.

In addition, the arrangement allows the generation of gas pressures much larger than would be achieved at ambient pressure and, provided that the motor has an adequate expansion ratio, this permits a marked reduction in gas consumption for a given power output, or a large increase in power output at the same gas flow.

To permit these greater amounts of heat storage it is desirable to pre-heat the buffer substance before use and this may be accomplished for instance by either an electric element or an electrical heating jacket 156 preferably fitted with a thermostatic cut-out. If intended as auxiliary power to an I.C. engine, the buffer container may be kept hot by means of the hot exhaust or other engine heat (eg the cylinder block). In all such cases it is usually desirable to thermally-insulate the tank and buffer container so that the stored heat does not leak away to the environment. Referring to FIG. 5, a disposable supply bottle or bulb 201 containing $CO_2$ (shown partly emptied) and painted on its outside surface with a thermally-conducting paint has a small oil-soaked pad 202 positioned immediately on the inside of a closure diaphragm 203. The supply bulb 201 is shown inserted in a holder 204 which is advantageously made of injection-moulded glass-reinforced nylon and which is provided with a lining 205 of metallic foam or mesh containing a first buffer substance 206 if the bulb contains 8g of $CO_2$, preferably which comprises approximately 2 grams of water.

The leftward end (as shown) of the holder 204 is provided with a female thread which engages with the male thread of a body member 207, and this thread not only supports the holder 204 but also allows the closure diaphragm 203 to be punctured by a hollow piercing needle 208 when it is desired to energize the gas supply apparatus by increasing the engagement of the threads. The holder 204 is sealed against loss of the first buffer substance 206 by means of an 'O' ring 209 and the neck of the supply bulb 201 is sealed against leakage of the $CO_2$ after puncturing by means of an 'O' ring 210 about the neck of the bulb 201. The piercing needle 208 is held in the body member 207 by means of a nut 211 and sealed by an 'O' ring 212 and soldered to a superheater tube 213 which is coiled within a superheater chamber 214 and which terminates with a soldered connection to a probe 215.

The superheater chamber 214 in this embodiment is housed between an end member 229 and the lefthand end face (as shown) of the body member 207. In this embodiment it may contain 1.5 grams of 99% glacial acetic acid/1% water (by volume) which comprises a second buffer 216 and which assists the superheating process to a vapour temperature of approximately 10° C. A coil retainer 217 in the form of a disc of plastic sheet (such as "Cobex" R T M PVC sheet) serves to contain the coils of the superheater tube 213. The probe 215 is provided with 'O' ring 218 and is pressed into a housing 219 after the application of an adhesive sealant such as "Loctite" (R T M). The probe housing 219 is itself pressed and sealed into the end member 229 either using "Loctite" (R T M) or possibly by moulding it into the end member 229 which, together with the body member 207, may advantageously be injection moulded in glass-reinforced nylon or acetal resin or similar plastics resistant to acetic acid. The superheater chamber may be sealed against loss of the second buffer 216 by means of an 'O' ring 220 or alternatively sealed to the body member 207 by an adhesive sealant or by spin or friction welding. All metallic parts in contact with the second buffer 216 are desirably made of aluminium or stainless steel or electro-plated mild steel when acetic acid is used; copper and copper containing metals such as brass are likely to corrode and are not therefore recommended.

Referring to FIG. 6 and FIG. 7 it will be seen that the motor is provided with a mounting flange 221 and mounting screws 222. The adaptor shown in FIG. 6 is so designed to marry with this mounting flange 221 and is provided with tapped attachment holes 223 positioned so as to accept the mounting screws 222 as indicated by the dashed lines, and thereby to allow the adaptor to be fixed to the motor. The leftward end (as shown) of the adaptor is provided with a socket 224 sized to take an inlet feed pipe 225 of the motor by means of a soldered connexion. The rightward end (as shown) of the adaptor is provided firstly with a male thread 226 which engages with a female thread in the leftward end (as shown) of the housing 219 shown in FIG. 5 so as to allow the motor plus adaptor to be quickly attached to the probe, and secondly with a chamfered socket 227 which is designed so as to accept the probe 215 and at the same to compress and seal the 'O' ring 218 of the end member in FIG. 5.

The oil-soaked porous pad 202 enables the issuing gas from the supply bulb 201 to carry with it droplets of oil into the motor. This technique is particularly useful where disposable supply bottles such as "Sparklets" bulbs are used, as on each occasion that a fresh supply bottle is slipped into the gas supply apparatus and used, the motor will receive fresh lubrication at the beginning of the run.

I claim:

1. A motor having in combination therewith apparatus for supplying to the motor gas evaporated from liquefied gas, said apparatus comprising a vessel containing liquefied gas, a passage which affords communication between the vessel and the motor whereby gas evaporating from the liquefied gas is conducted into the motor, and in heat conductive relationship with the vessel, at least one container holding a buffer substance which during operation of the motor releases heat to the vessel and the liquefied gas therein, whereby the tendency of the evaporation of the liquefied gas to cool the remaining liquefied gas in the vessel is at least partly counteracted.

2. A motor according to claim 1, in which the buffer substance is contained in a jacket surrounding the vessel.

3. A motor according to claim 1, in which the said container is located in the vessel.

4. A motor according to claim 1, in which the vessel has associated therewith means for pre-heating the substance.

5. A motor according to claim 1, additionally including manually operable means for placing the passage in communication within the vessel.

6. A motor according to claim 1, in which the buffer substance is a liquid which freezes at a temperature between ambient temperature and the final operating temperature of the liquefied gas.

7. A motor according to claim 1, in which the passage has means for causing the evaporated gas to undergo a pressure drop of more than 10% of the saturation pressure of the liquefied gas at the prevailing temperature of the liquefied gas in the vessel, whereby the speed of the motor is able to be stabilised.

8. A motor according to claim 7, in which there is at least one secondary container holding buffer substance in heat conductive relationship with at least part of the said passage.

9. A motor according to claim 8, in which the buffer substance in the said secondary container is a liquid which on freezing releases heat to evaporated gas flowing through the passage, and which has a freezing point between ambient temperature and the temperature of the evaporated gas entering the passage, and in which the buffer substance in the said container in heat conductive relationship with the vessel is a liquid which on freezing releases heat and which has a freezing point between ambient temperature and the temperature of the liquefied gas in the vessel, the buffer substance in the secondary container having a freezing point greater than the freezing point of the buffer substance in the said container in heat conductive relationship with the vessel.

10. A motor having in combination therewith apparatus for supplying to the motor gas evaporated from liquefied gas, said apparatus comprising a vessel containing liquefied gas, a passage which affords communication between the vessel and the motor whereby gas evaporating from the liquefied gas is conducted into the motor, and, in heat conductive relationship with at least part of the passage at least one container holding a buffer substance which during operation of the motor releases heat to evaporated gas as it passes through the passage thereby raising the temperature of said evaporated gas.

* * * * *